US006415581B1

(12) United States Patent
Shipman et al.

(10) Patent No.: US 6,415,581 B1
(45) Date of Patent: Jul. 9, 2002

(54) CORRUGATED STIFFENING MEMBER

(75) Inventors: Jerry Shipman, Stockton; Willie Oehrlein, Escalon; Joe Orgon, Valley Springs, all of CA (US)

(73) Assignee: Deck West, Incorporated, Stockton, CA (US)

( * ) Notice: Subject to any disclaimer, the term of this patent is extended or adjusted under 35 U.S.C. 154(b) by 0 days.

(21) Appl. No.: 09/617,468

(22) Filed: Jul. 17, 2000

(51) Int. Cl.[7] ..... E04C 2/32

(52) U.S. Cl. ..... 52/798.1; 52/514; 52/537; 52/783.11; 52/DIG. 15; 428/599; 428/603; 428/593; 428/594; 428/604

(58) Field of Search ..... 52/798.1, 514, 52/537, 783.11, DIG. 15; 428/599, 603, 593, 594, 604

(56) References Cited

U.S. PATENT DOCUMENTS

| | | | | |
|---|---|---|---|---|
| 2,950,788 A | * | 8/1960 | Edgar | 52/537 |
| 3,111,788 A | * | 11/1963 | Ouellet | 52/537 |
| 3,208,189 A | * | 9/1965 | Hickman | 52/537 |
| 4,186,535 A | | 2/1980 | Morton | |
| 4,333,280 A | | 6/1982 | Morton | |
| 4,335,557 A | | 6/1982 | Morton | |
| 4,894,967 A | | 1/1990 | Morton | |
| 5,950,383 A | * | 9/1999 | Williamson | 52/537 |

FOREIGN PATENT DOCUMENTS

| | | | |
|---|---|---|---|
| CA | 602190 | * | 7/1960 |

* cited by examiner

*Primary Examiner*—Carl D. Friedman
*Assistant Examiner*—Chi Q. Nguyen
(74) *Attorney, Agent, or Firm*—Audrey A. Milleman

(57) ABSTRACT

A stiffening member, as well as a diaphragm of a building in which the stiffening member is used, is disclosed. The diaphragm includes a horizontal wide-flange beam, a corrugated deck, and a corrugated stiffening member. The stiffening member is an elongate, corrugated strip. The stiffening member's corrugations are formed by a series of U-shaped portions that alternate with, and are integrally connected to, a series of horizontal upper portions. Each U-shaped portion consists of three planar portions: two substantially vertical side portions and one horizontal floor portion. Each U-shaped portion is reinforced with two parallel raised ribs. In a second embodiment of the stiffening member, the U-shaped portion is reinforced with two parallel tab portions attached at the sides of the stiffening member. The stiffening member nestingly overlies the corrugated deck, and is attached to the deck and to the underlying horizontal beam with either welds or pins.

15 Claims, 17 Drawing Sheets

CORRUGATED STIFFENING MEMBER

BACKGROUND OF THE INVENTION

1. Field of the Invention

The present invention relates generally to stiffening members used in constructing buildings to resist horizontal shear forces and, more particularly, to metal stiffening members used to reinforce roofs and floors of corrugated metal decking.

2. Description of the Related Art

Corrugated metal decking is used in the construction of large buildings, as part of a horizontal floor or roof structure. Such structures are generally referred to as diaphragms. In addition to serving as floors and roofs, diaphragms give the building resistance to horizontal shear forces, such as are caused by wind and earthquakes.

A corrugated deck consists of multiple deck panels. Each panel consists of repeating corrugations, where the corrugations extend parallel to the longitudinal axis of the deck panel. Deck panels are usually attached to each other at their side (longitudinal) edges by an overlapping joint known as a sidelap joint. Deck panels are also usually attached to each other at their ends in an overlapping fashion. Welds are typically used to attach deck panels to each other and to underlying horizontal support structures, such as wide-flange beams.

If subjected to a horizontal shear force of sufficient strength, a diaphragm will eventually buckle or compress. The ability of a diaphragm to resist horizontal shear forces depends on several factors, including the thickness of the deck, the size of the deck, the stiffness of the deck, and the way in which the deck is attached to the supporting structure. The stiffer the diaphragm, the greater the degree of shear resistence.

Several different types of stiffening members or shear resisting structures have been used to provide additional shear resistance to a diaphragm. U.S. Pat. No. 4,894,967 issued to Morton discloses a diaphragm including a fluted or corrugated deck and a shear resisting member. The fluted deck is supported by horizontal support beams. The shear resisting member is attached to the top of the fluted deck, perpendicular to the flutes of the deck. The shear resisting member has a horizontal portion that is welded to the tops of the flutes of the deck, using a fillet type of weld. The shear resisting member also has vertical tabs that extend downward into the troughs of the flutes of the deck and are welded to the troughs of the deck and through the troughs to the horizontal support beam, using an arc spot type of weld. Thus, the shear resisting member requires two different welds per flute or corrugation, necessitating different tools and different welding materials.

U.S. Pat. No. 4,186,535, 4,333,280, and 4,335,557, also issued to Morton, disclose a diaphragm including a fluted deck and a load translation member similar to that disclosed by U.S. Pat. No. 4,894,967. The load translation member may be Z-shaped or C-shaped or a profile plate member. The load translation member is welded to the open end of a fluted deck and therefore cannot be used with a cantilevered deck (i.e., a deck where the open end of the deck extends past the underlying wide-flange beam). The Z-shaped and C-shaped load translation members also cannot be used where the end of the deck abuts a vertical wall or where two deck panels are joined with their ends abutting (an interior butt joint). Although the profile plate member can be used where the deck abuts a vertical wall and on interior butt joints, it is not easy to install and requires considerable time and expense. The profile plate member also does not provide shear resistance to both deck panels in an interior butt joint.

Thus, the known stiffening members are unsatisfactory. Some cannot be used with a cantilevered deck. Those that can be used with a cantilevered deck are not satisfactory because they require two different types of welds per flute or corrugation, resulting in increased time, complexity, labor costs, and material costs. Other types of stiffening members cannot be used, or are more difficult and costly to use, where the deck abuts a vertical wall or in an interior butt joint. Thus, there is a need for a stiffening member that can be used with a cantilevered corrugated deck that can be installed in an efficient and cost-effective fashion. There is also a need for a stiffening member that can be used where a deck abuts a vertical wall and where an interior butt joint is used.

SUMMARY OF THE INVENTION

The stiffening member of the present invention is adapted to overcome the above-noted shortcomings and to fulfill the needs of providing a stiffening member that can be used with a cantilevered deck and is quick, easy, and cost-effective to install.

One aspect of the invention comprises a stiffening member for use in a diaphragm of a building. The stiffening member comprises a plurality of U-shaped portions with an outer surface, a plurality of horizontal, planar upper portions, an integral connection between one of the U-shaped portion's side portions and an upper portion, and an integral connection between the other of the U-shaped portion's side portions and another upper portion. Each U-shaped portion comprises first and second substantially vertical, planar side portions, a horizontal, planar floor portion, first and second corners integrally connecting the floor portion to the first and second side portions, respectively, and means for reinforcing one of the corners.

Another aspect of the invention includes a diaphragm of a building, comprising a horizontal structural member, a corrugated deck, the stiffening member described above, and means for attaching the stiffening member to the deck and to the horizontal structural member.

It is an object of the present invention to provide a stiffening member to be used in building diaphragms, including corrugated metal decking, to resist horizontal shear forces.

It is a further object of the invention to provide a stiffening member that can be used in cantilevered decks.

It is another object of the invention to provide a stiffening member that can be attached to corrugated metal decking in an easier, more cost-effective and less time-consuming fashion than existing shear resisting members.

It is yet another object of the invention to provide a stiffening member that can be attached to corrugated metal decking by a single weld per corrugation.

It is also an object of the invention to provide a stiffening member that can be attached to corrugated metal decking by a pin rather than a weld.

It is another object of the invention to provide a stiffening member that can be used where a deck abuts a vertical wall.

It is another object of the invention to provide a stiffening member that can be used in an interior butt joint.

It is also an object of the invention to provide a stiffening member that can be installed using the same type of welds that are used to construct corrugated decks.

Still further objects of the inventive structure disclosed herein will be apparent from the drawings and the following detailed description thereof.

DETAILED DESCRIPTION OF THE PREFERRED EMBODIMENT OF THE INVENTION

Figure 1:
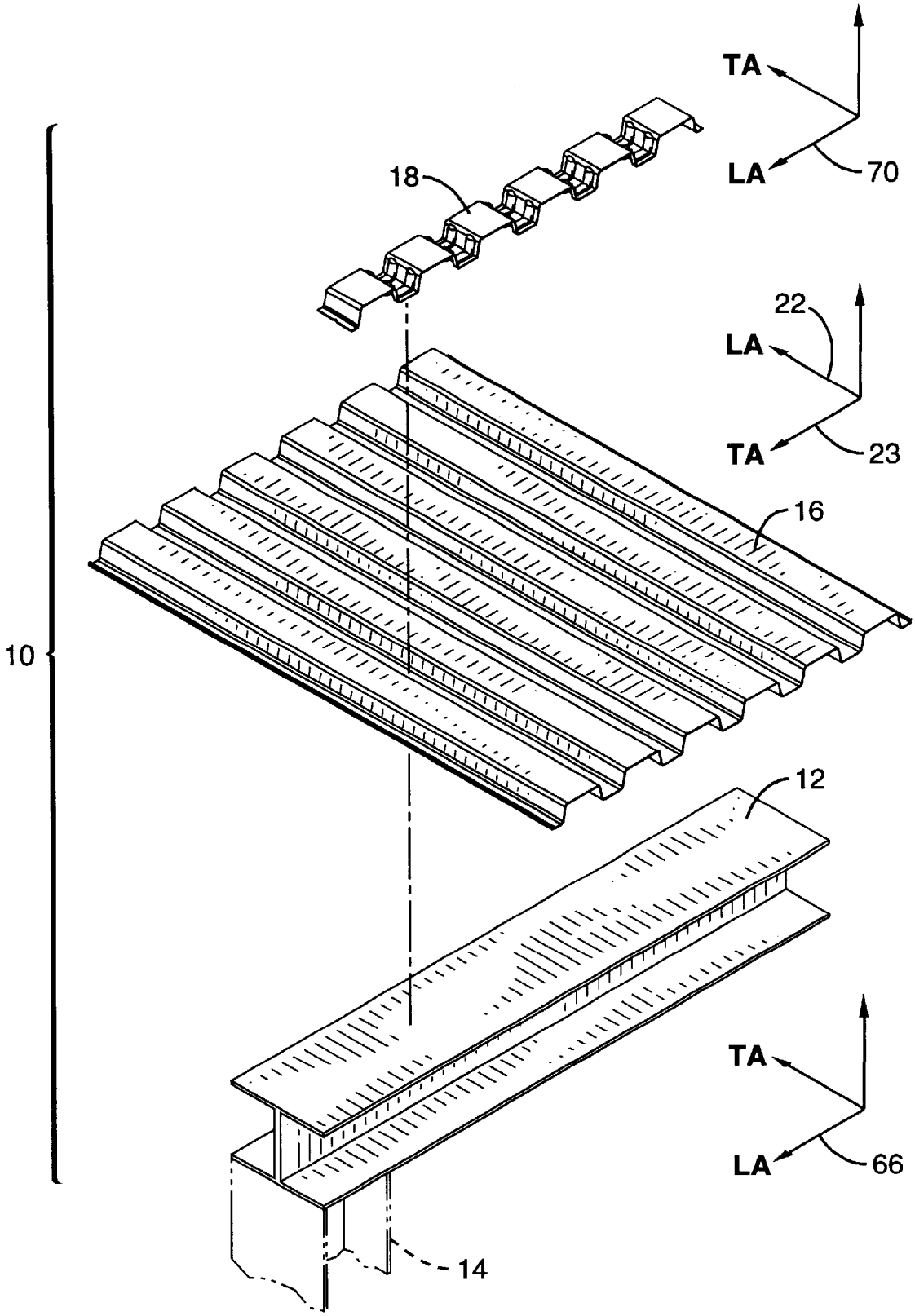
FIG. 1 is a partially exploded perspective view of the stiffening member of the invention as it is assembled in a diaphragm, showing the relevant axes of the components of the diaphragm.
Figure 2:
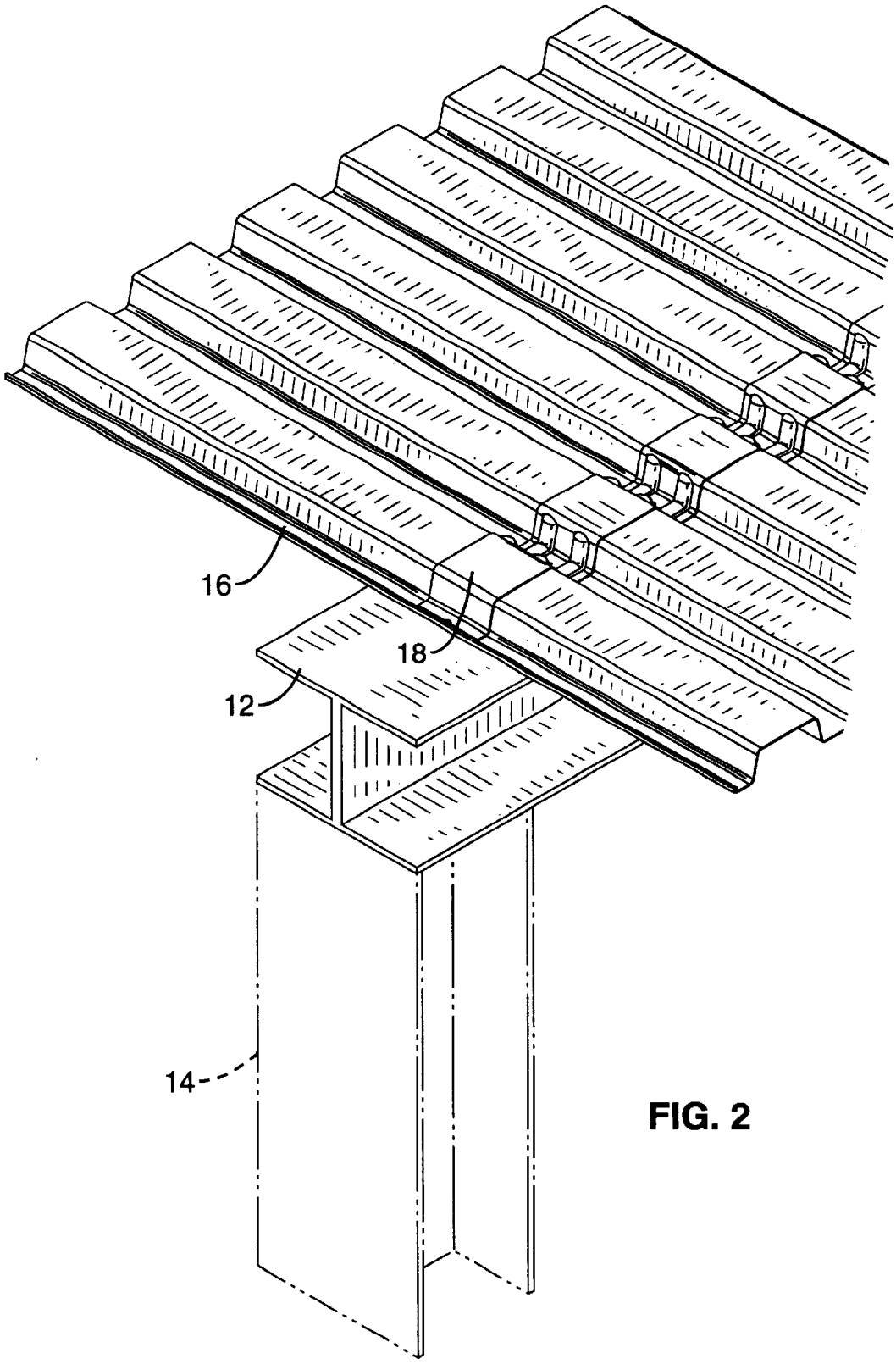
FIG. 2 is a perspective view of the stiffening member in a diaphragm.

FIGS. 1 and 2 show diaphragm 10 of a building. Diaphragm 10 includes at least one horizontal support structure 12, which is typically a wide-flange beam, corrugated deck 16, and corrugated stiffening member 18. Diaphragm 10 may include multiple horizontal support structures 12. Diaphragm 10 is supported by vertical support structure 14, which may be a wall or beam.

Figure 3:
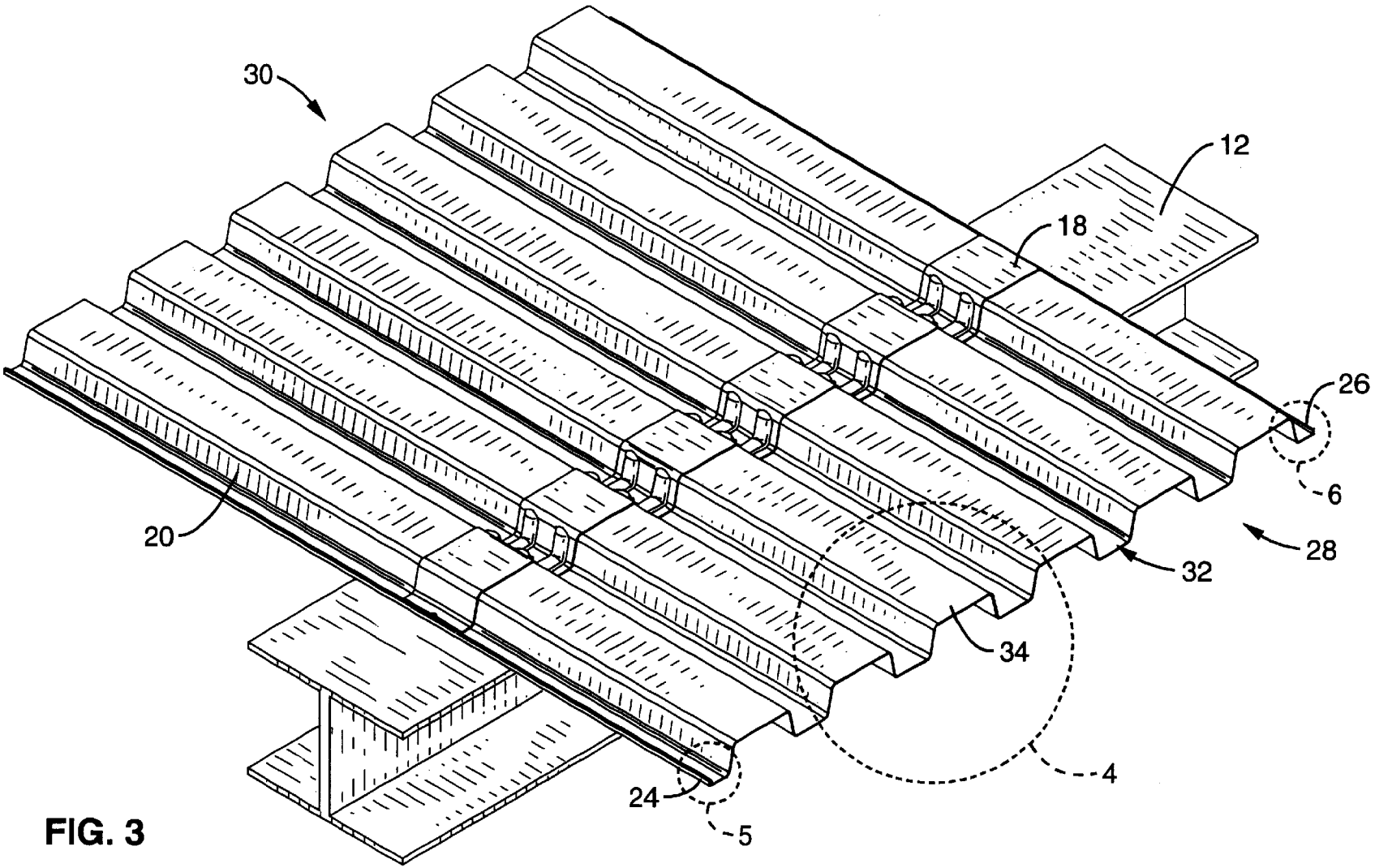
FIG. 3 is a perspective view of the stiffening member in a diaphragm showing both ends of the deck panel

Deck 16 includes one or more deck panels 20. As shown in FIG. 3, deck panel 20 is rectangular in shape and has longitudinal axis 22 and transverse horizontal axis 23. Deck panel 20 has two side edge components, left side edge component 24 and right side edge component 26, which extend in a direction parallel to longitudinal axis 22. Deck panel 20 also has two ends, first end 28 and second end 30, which extend in a direction perpendicular to longitudinal axis 22. Deck panel 20 is corrugated, with parallel corrugations extending lengthwise in a direction parallel to longitudinal axis 22. The corrugations of deck panel 20 are formed by a series of substantially identical U-shaped portions 32 (i.e., U-shaped in cross-section) which alternate with a series of substantially identical upper portions 34. In the example shown, deck panel 20 consists of five U-shaped portions 32 and six upper portions 34.

Figure 4:
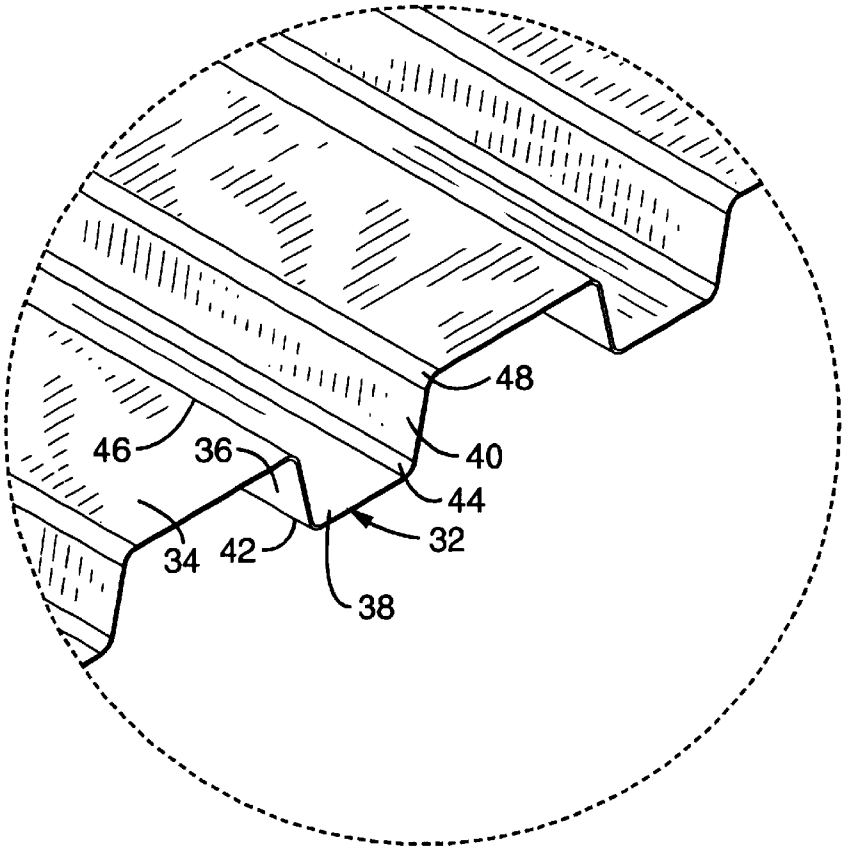
FIG. 4 is an enlarged perspective view of a portion of the first end of the deck panel of FIG. 3.

As shown in FIG. 4, each U-shaped portion 32 is comprised of three planar portions: a first side portion 36, a horizontal floor portion 38, and a second side portion 40. Side portions 36 and 40 are generally vertical and lie in planes that are generally at right angles to the plane of floor portion 38. First side portion 36 and second side portion 40 diverge from one another such that there are opposing obtuse angles between each side portion and floor portion 38. The angles are preferably about 102 degrees. First side portion 36 is integrally adjoined to floor portion 38 at first corner 42. Floor portion 38 is integrally adjoined to second side portion 40 at second corner 44.

Each of deck panel 20's upper portions 34 is horizontal and planar, and resides in a plane parallel to and above the plane of floor portion 38, as shown in FIG. 4. First side portion 36 is integrally adjoined to an upper portion 34 at third corner 46. Second side portion 40 is integrally adjoined to another upper portion 34 at fourth corner 48. Thus, each upper portion 34 is integrally adjoined to a first side portion 36 of one U-shaped portion 32 at a third corner 46 and integrally adjoined to a second side portion 40 of another U-shaped portion 32 at a fourth corner 48.

Figure 5:
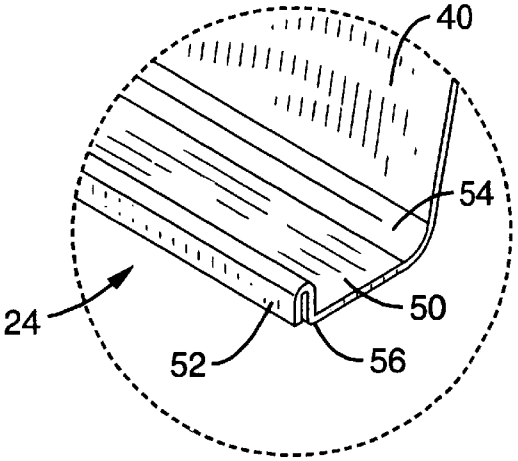
FIG. 5 is an enlarge perspective view of the left side edge component of the deck panel of FIG 3.

As shown in FIG. 5, deck panel 20's left side edge component 24 consists of a second side portion 40, left horizontal planar portion 50, and a vertical inverted U-shaped portion 52, integrally adjoined to each other. Vertical inverted U-shaped portion 52 is shaped like an inverted U in cross-section. Second side portion 40 is integrally adjoined to left horizontal planar portion 50 at fifth corner 54. Left horizontal planar portion 50 is integrally adjoined to vertical inverted U-shaped portion 52 at sixth corner 56. Vertical inverted U-shaped portion 52 projects upward from left horizontal planar portion 50 only a short distance in comparison with second side portion 40. The angle between second side portion 40 and left horizontal planar portion 50 is substantially the same as the angle between second side portion 40 and floor portion 38, preferably about 102 degrees. The angle between left horizontal planar portion 50 and vertical inverted U-shaped portion 52 is approximately 90 degrees.

Figure 6:
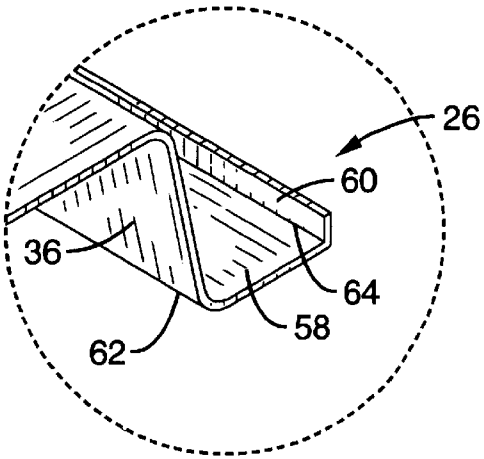
FIG. 6 is an enlarged perspective view of the right side edge component of the deck panel of FIG. 3.

As shown in FIG. 6, deck panel 20's right side edge component 26 consists of a first side portion 36, right horizontal planar portion 58, and vertical planar portion 60, integrally adjoined to each other. First side portion 36 is integrally adjoined to right horizontal planar portion 58 at seventh corner 62. Right horizontal planar portion 58 is integrally adjoined to vertical planar portion 60 at eighth corner 64. Vertical planar portion 60 projects upward from right horizontal planar portion 58 only a short distance in comparison with first side portion 36. The angle between first side portion 36 and right horizontal planar portion 58 is substantially the same as the angle between first side portion 36 and floor portion 38, preferably about 102 degrees. The angle between right horizontal planar portion 58 and vertical planar portion 60 is approximately 90 degrees.

Deck panel 20 is available from several different sources, including Deck West Incorporated of Stockton, Calif. Corrugated deck panels are available in a number of different lengths, widths, depths, and metal gauges (thicknesses). For example, in a deck panel 20 having a width of 36 inches along its transverse horizontal axis 23, upper portion 34 is preferably about three and three-eighths inches wide. The width of floor portion 38 is preferably about one and three-fourths inches. The depth of U-shaped portion 32, i.e., the vertical distance between the plane of upper portion 34 and the plane of floor portion 38, is preferably approximately one and one-half inches. The width of left horizontal planar portion 50 is preferably about three-fourths inch. The width of right horizontal planar portion 58 is preferably about three-fourths inch. The height of vertical inverted U-shaped portion 52 is preferably about three-fourths to seven-eighths inch. The height of vertical planar portion 60 is preferably about three-fourths to seven-eights inch. Deck panel 20 can be made of 16, 18, 20, or 22 gauge steel.

Figure 7:
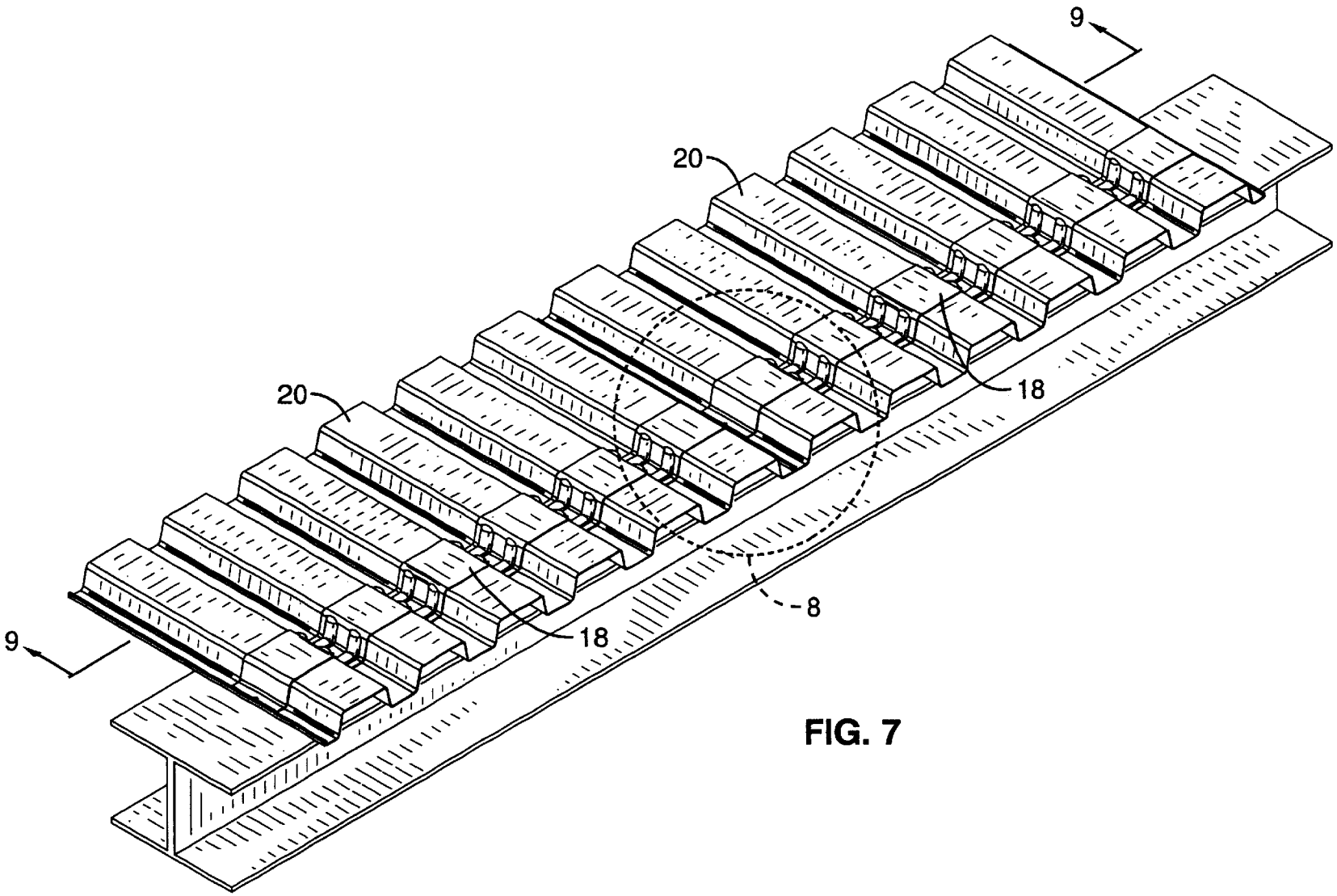
FIG. 7 is a perspective view of two stiffening members as used in a diaphragm, showing a sidelap joint of two deck panels.
Figure 8:
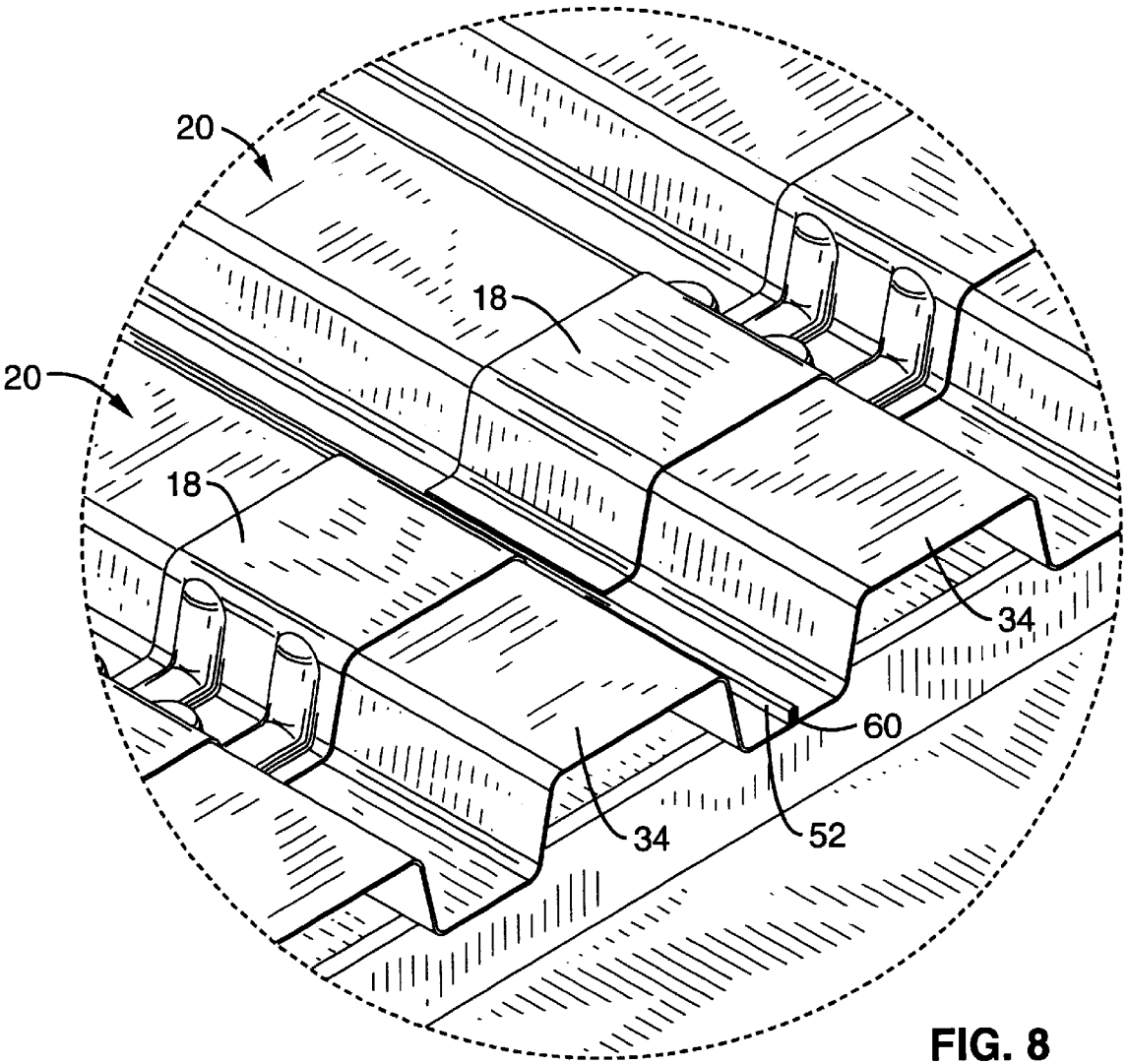
FIG. 8 is an enlarged perspective view of portions of the two stiffening members, two deck panels, and sidelap joint of FIG. 7.
Figure 9:
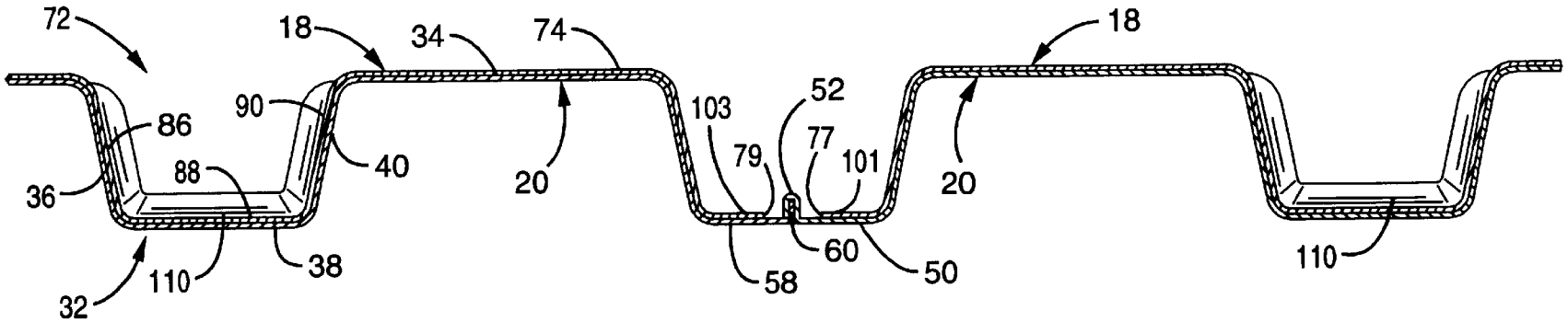
FIG. 9 is a longitudinal cross-sectional view of portions of two stiffening members, two deck panels, and a sidelap joint of two deck panels.

Corrugated deck diaphragms are usually constructed of multiple deck panels 20. Two deck panels 20 are typically attached to each other at their sides in a type of deck joint known as a sidelap joint, as shown in FIGS. 7, 8, and 9. Left side edge component 24 of one deck panel 20 is connected to right side edge component 26 of another deck panel 20. The sidelap joint is formed by the interlocking of vertical inverted U-shaped portion 52 of one deck panel 20 with vertical planar portion 60 of another deck panel 20. The sidelap joint is typically secured by a weld, screw, or button punch which joins vertical inverted U-shaped portion 52 and vertical planar portion 60 together.

Figure 10:
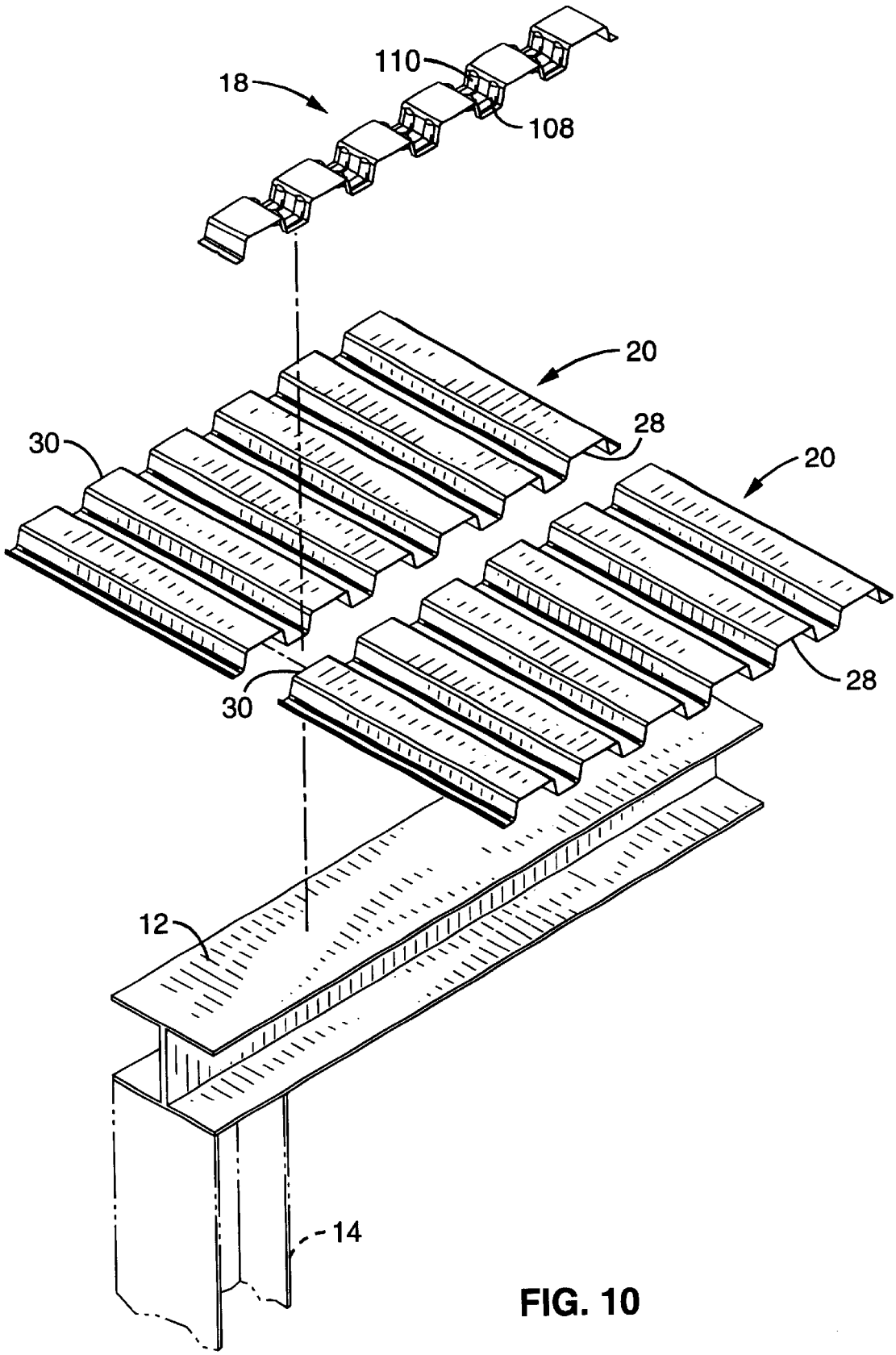
FIG. 10 is a partially exploded perspective view of the stiffening member in a diaphragm, showing an interior butt joint of two deck panels.

Two deck panels 20 may be attached to each other at their ends by a type of deck joint known as an interior butt joint, as shown in FIG. 10. This is formed by abutting first end 28 of one deck panel 20 against second end 30 of another deck panel 20, such that the juncture of first end 28 and second end 30 resides on top of, and is centered on, horizontal support structure 12. Each deck panel 20 is attached to underlying horizontal support structure 12 by welds or pins.

Figure 11:
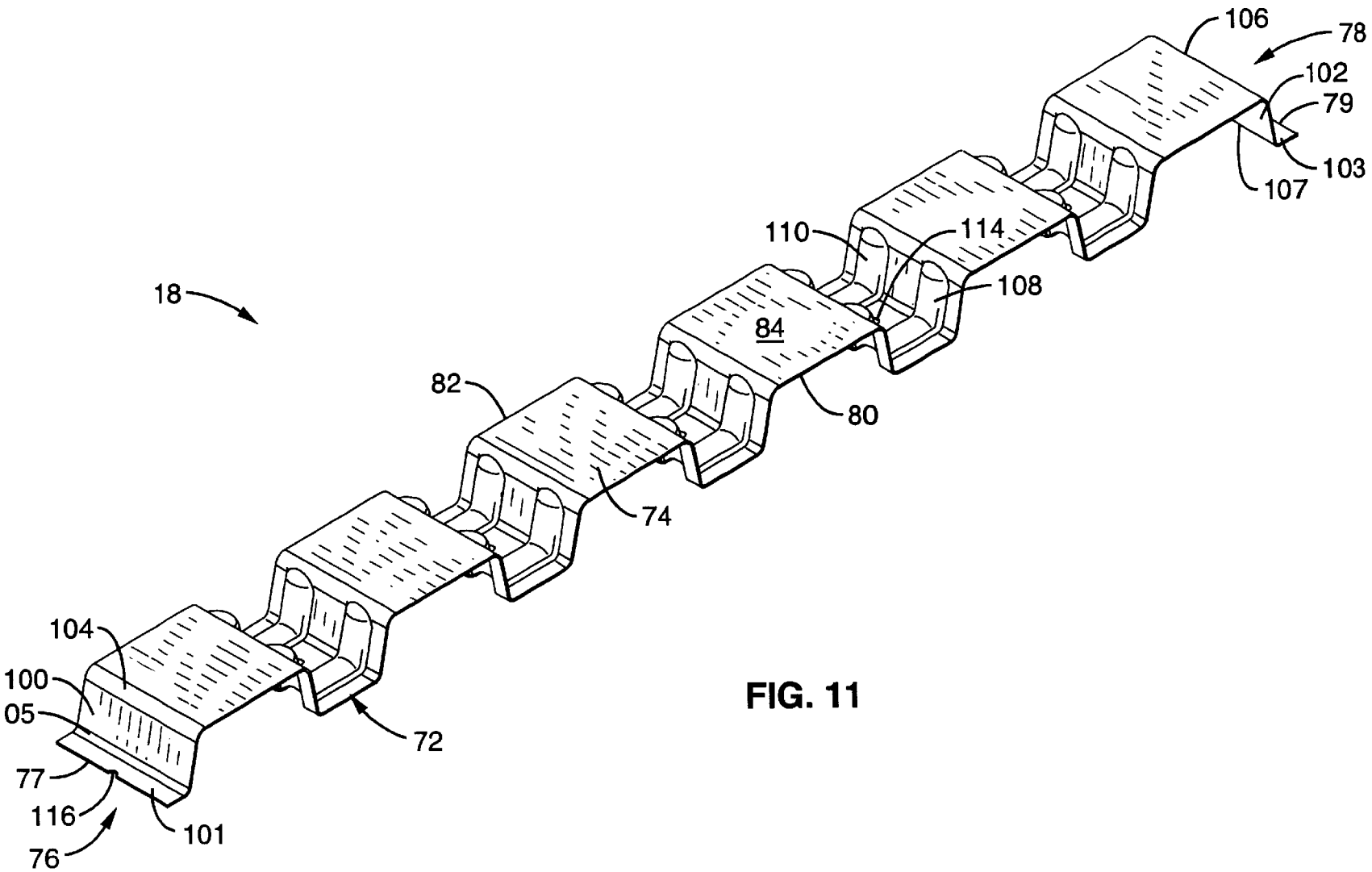
FIG. 11 is a perspective view of the ribbed first embodiment of the stiffening member of the invention, further including pre-punched holes and notches.
Figures 12, 13:
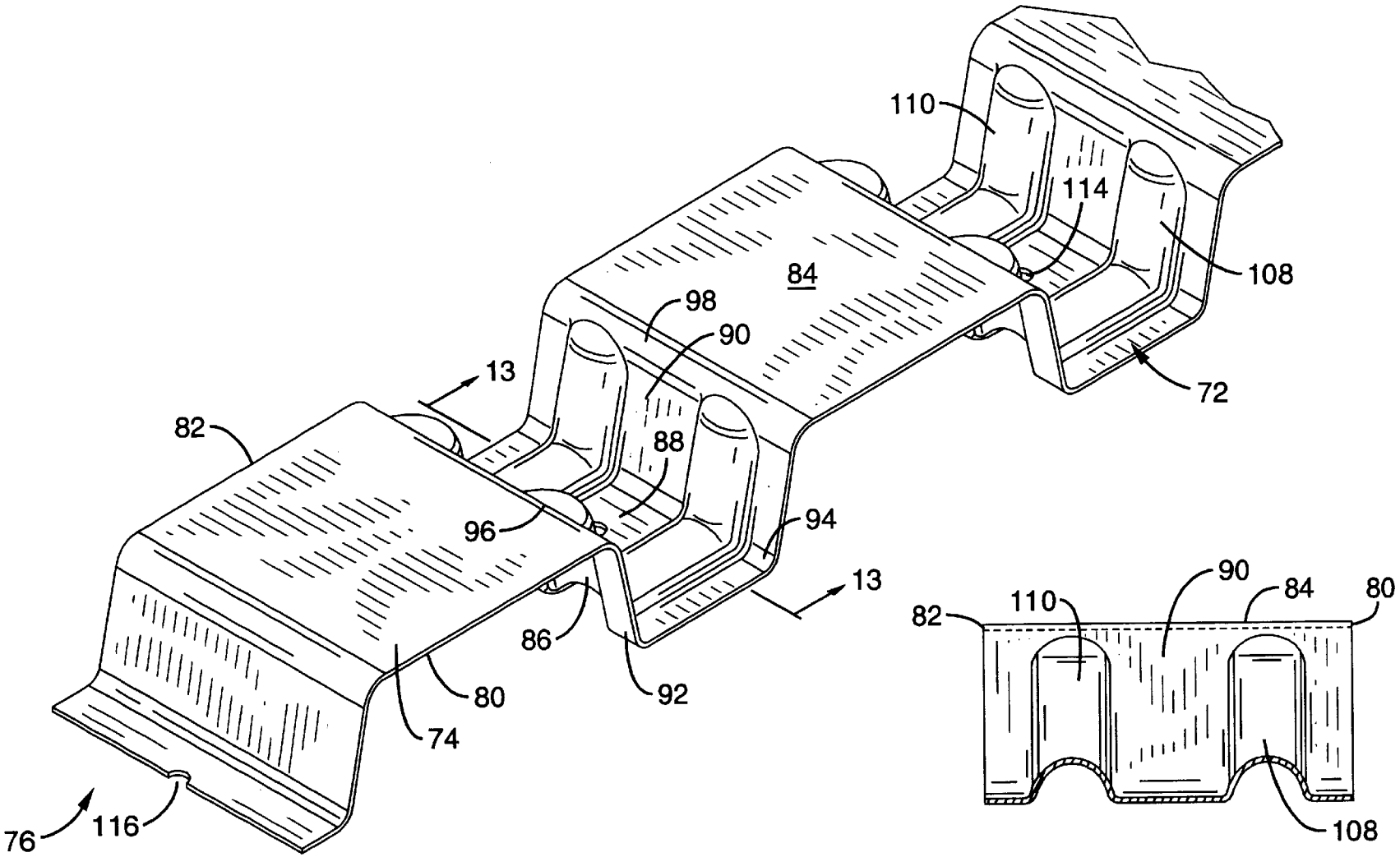
FIG. 12 is an enlarged fragmentary perspective view of the stiffening member of FIG. 11.
FIG. 13 is a transverse cross-sectional view of the stiffening member taken on lines 13—13 of FIG. 12.

FIGS. 11 and 12 show stiffening member 18. Stiffening member 18 is an elongate, corrugated strip, having longitudinal axis 70. The corrugations of stiffening member 18 are formed by a series of substantially identical U-shaped portions 72 (i.e. U-shaped in cross-section) that alternate with, and are connected by, a series of substantially identical upper portions 74. In the example shown, stiffening member 18 consists of five U-shaped portions 72 and six upper portions 74. Stiffening member 18 also has a first end portion 76, a first end edge 77, a second end portion 78, a second end edge 79, a first side edge 80, a second side edge 82, and an outer surface 84.

Each U-shaped portion 72 is comprised of three planar portions: a first side portion 86, a horizontal floor portion 88, and a second side portion 90. Side portions 86 and 90 are generally vertical and lie in planes that are generally at right angles to the plane of floor portion 88. First side portion 86 and second side portion 90 diverge from one another such that there are opposing obtuse angles between each side portion and floor portion 88. The angles are preferably about 102 degrees. First side portion 86 is integrally adjoined to floor portion 88 at first corner 92. Floor portion 88 is integrally adjoined to second side portion 90 at second corner 94.

Each of stiffening member 18's upper portions 74 is horizontal and planar, and resides in a plane parallel to and above the plane of floor portion 88. First side portion 86 is integrally adjoined to an upper portion 74 at third corner 96. Second side portion 90 is integrally adjoined to another upper portion 74 at fourth corner 98. Thus, each upper portion 74, except for those connected to first end portion 76 and second end portion 78, is integrally adjoined to a first side portion 86 of one U-shaped portion 72 at a third corner 96 and integrally adjoined to a second side portion 90 of another U-shaped portion 72 at a fourth corner 98.

First end portion 76 consists of two planar portions: first end vertical side portion 100 and first end horizontal portion 101. Second end portion 78 consists of two planar portions: second end vertical side portion 102 and second end horizontal portion 103. Vertical side portions 100 and 102 are generally vertical and lie in planes that are generally at right angles to the planes of horizontal portions 101 and 103, respectively. First end vertical side portion 100 is integrally adjoined to an upper portion 74 at fifth corner 104. First end vertical side portion 100 is integrally adjoined to first end horizontal portion 101 at sixth corner 105. The angle between first end vertical side portion 100 and first end horizontal portion 101 is substantially the same as the angle between second side portion 90 and floor portion 88, preferably about 102 degrees. Second end vertical side portion 102 is integrally adjoined to an upper portion 74 at seventh corner 106. Second end vertical side portion 102 is integrally adjoined to second end horizontal portion 103 at eighth corner 107. The angle between second end vertical side portion 102 and second end horizontal portion 103 is substantially the same as the angle between first side portion 86 and floor portion 88, preferably about 102 degrees. First end horizontal portion 101 has first end edge 77, which is parallel to sixth corner 105. Second end horizontal portion 103 has second end edge 79, which is parallel to eighth corner 107.

In a first embodiment of stiffening member 18, as shown in FIGS. 11 and 12, a series of substantially identical pairs of first and second raised ribs 108 and 110 project from stiffening member 18's outer surface 84 along each U-shaped portion 72. Raised ribs 108 and 110 are parallel to each other and extend parallel to side edges 80 and 82, preferably continuously from third corner 96 down first side portion 86 to first corner 92, along floor portion 88 to second corner 94, and up second side portion 90 to fourth corner 98. In a stiffening member 18 that is three and one-half inches wide, the preferred dimensions are as follows. Each raised rib 108 and 110 is preferably about seven-eighths inch wide. Raised ribs 108 and 110 are preferably about one inch apart and equidistant from the longitudinal midline of U-shaped portion 72. Measured from the midpoint of its width, raised rib 108 is preferably located three-eighths inch from first side edge 80. Measured from the midpoint of its width, raised rib 110 is preferably located three-eighths inch from second side edge 82.

As shown in longitudinal and transverse cross-sections in FIGS. 9 and 13, respectively, raised ribs 108 and 110 are preferably embossed in, and integrated into, stiffening member 18. The embossment is done by pressing raised ribs 108 and 110 into the stiffening member 18, such that the undersides of raised ribs 108 and 110 are concave. Raised ribs 108 and 110 may also be satisfactorily constructed in other ways. For example, raised ribs 108 and 110 may be solid thickened portions molded into stiffening member 18 or constructed separately and welded thereto. Raised ribs 108 and 110 are preferably semicircular in their cross-sectional shape, having a diameter of about five-eighths inch.

Figure 14:
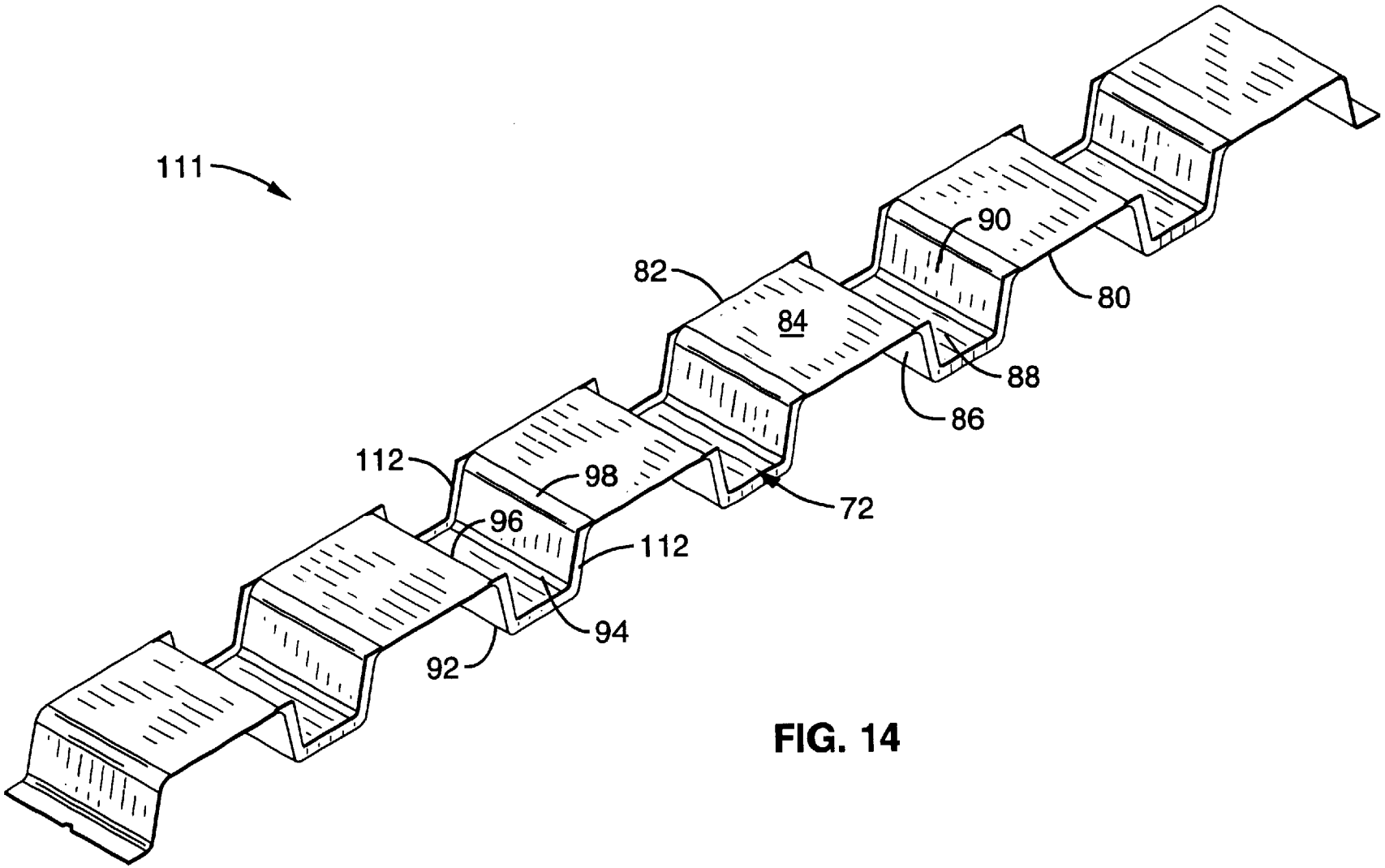
FIG. 14 is a perspective view of the tabbed second embodiment of the stiffening member of the invention, further including pre-punched holes and notches.

In a second embodiment of the invention, as shown in FIG. 14, stiffening member 111 has a series of substantially identical pairs of planar tab portions 112 that project from stiffening member 111's outer surface 84 along each U-shaped portion 72. Each tab portion 112 is attached to first side portion 86, floor portion 88, and second side portion 90, at first side edge 80 or second side edge 82, perpendicular to the plane of the side portion or floor portion to which it is attached. Tab portions 112 extend, preferably continuously, from third corner 96 down first side portion 86 to first corner 92, along floor portion 88 to second corner 94, and up second side portion 90 to fourth corner 98. Thus, tab portions 112 are preferably U-shaped, corresponding in shape to the U of stiffening member 111's U-shaped portion 72. Tab portions 112 are preferably integrally adjoined to stiffening member 111 and may be formed by rolling or folding edge portions of stiffening member 111's U-shaped portion. Tab portions 112 may also be constructed separately and welded to stiffening member 111. The height of tab portions 112 is preferably about three-eighths inch to one-half inch.

Both the first and second embodiments of the stiffening member, 18 and 111, may, but need not, be made with pre-punched holes and notches to facilitate the formation of arc spot welds used to attach stiffening member 18 to deck panel 20. Stiffening members 18 and 111 are typically made without such holes and notches if pins are used. The following discussion and examples refer to first embodiment of stiffening member 18 for convenience, but shall be understood not to be limited to that embodiment, where applicable. In one aspect of the invention, as shown in FIGS. 11 and 12, stiffening member 18 includes a series of pre-punched holes and notches. A single pre-punched hole 114, preferably one-half inch in diameter, resides in the center of each floor portion 88. Thus, a stiffening member 18 having five U-shaped portions 72 has five pre-punched holes 114. A single pre-punched half-circle end notch 116, preferably one-half inch in diameter, resides in the center of each of first end edge 77 and second end edge 79.

Figure 15:
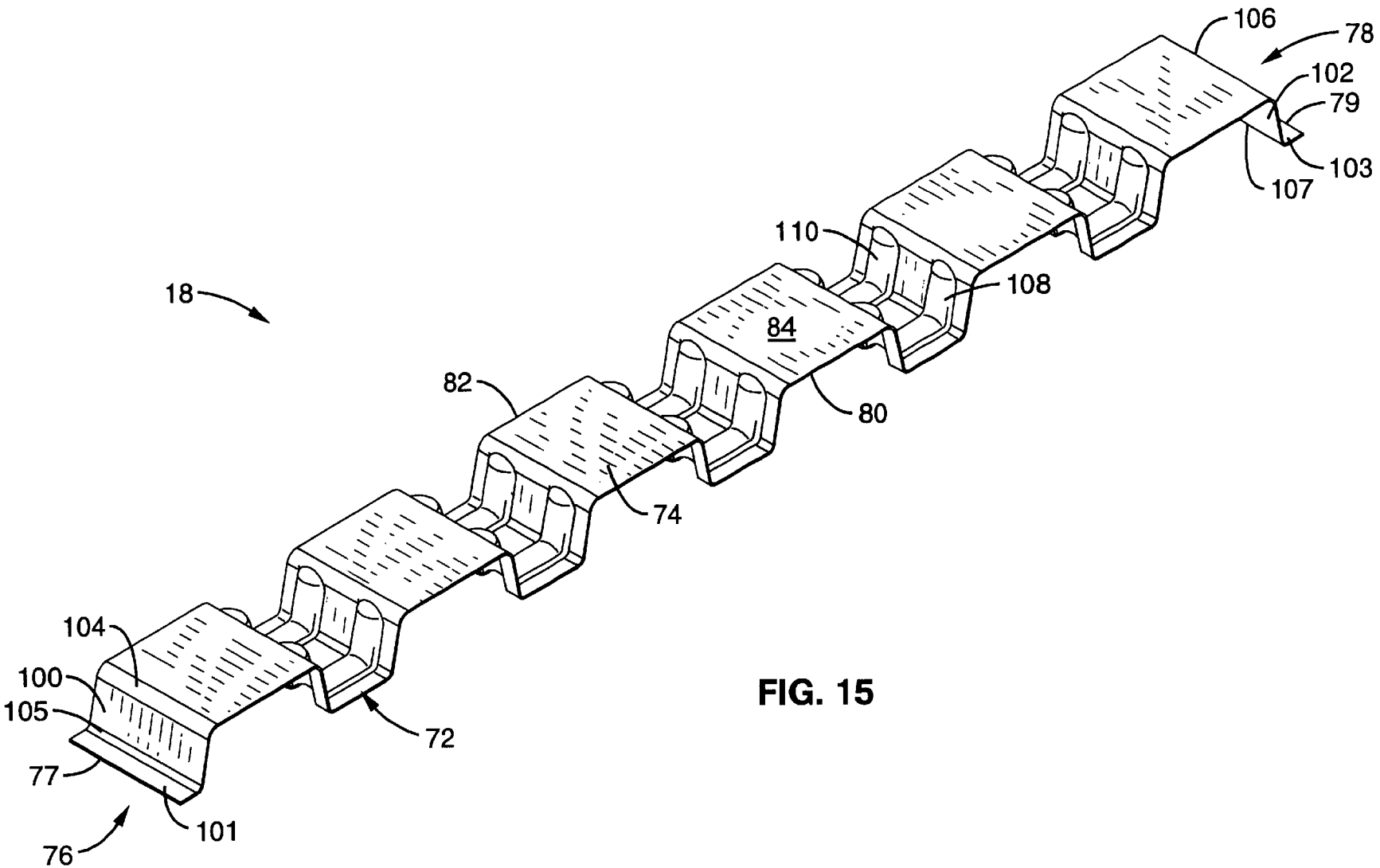
FIG. 15 is a perspective view of the ribbed first embodiment of the stiffening member, without pre-punched holes and without pre-punched notches.

In another aspect of the invention, as shown in FIG. 15, stiffening member 18 does not include any pre-punched holes or notches. Such configuration is considered preferable when employing pins to attach stiffening member 18 to deck panel 20.

Stiffening member 18 is preferably about three and one-half inches wide by about 34 inches long, along longitudinal axis 70, when used with a 36-inch wide corrugated deck panel 20. The preferable dimensions are as follows. Each upper portion 74 is approximately three and one-half inches by three and one-half inches. Each floor portion 88 is approximately three and one-fourth inches by one and five-eighths inches. First and second horizontal portions 101 and 103 are each approximately three and one-half inches by one-half inch. The depth of each U-shaped portion 72, i.e., the vertical distance between the plane of upper portion 74 and the plane of floor portion 88, is approximately one and five-eighths inches.

Stiffening member 18 is preferably constructed of 18 gauge steel. However, steel in different gauges, as well as other metals, materials, or composites may be preferred for specific purposes.

FIGS. 1, 2, 3, 9, 16, and 17 show stiffening member 18 in use in a diaphragm of a building. The diaphragm shown is a cantilevered deck, i.e., a deck having an end extending beyond the underlying horizontal support structure. This is only an example, and stiffening member 18 may be used in diaphragms of a variety of different configurations, including where the deck abuts a vertical wall, or where two deck panels are joined together in an interior butt joint. Stiffening member 18 is disposed on top of, and is nestingly engaged within the corrugations of, deck panel 20. Deck panel 20 is disposed on top of horizontal support structure 12. Stiffening member 18's longitudinal axis 70 is perpendicular to deck panel 20's longitudinal axis 22, and parallel to horizontal support structure 12's longitudinal axis 66. Stiffening member 18's U-shaped portions 72 nest within deck panel 20's U-shaped portions 32. Stiffening member 18's first side portions 86 are disposed adjacent to deck panel 20's first side portions 36. Stiffening member 18's floor portions 88 are disposed on top of deck panel 20's floor portions 38. Stiffening member 18's second side portions 90 are disposed adjacent to deck panel 20's second side portions 40. Stiffening member 18's upper portions 74 are disposed on top of deck panel 20's upper portions 34. The dimensions and relative angles of the components of stiffening member 18 are such that, when stiffening member 18 is disposed on top of deck panel 20, U-shaped portions 72 of stiffening member 18 fit nestingly into U-shaped portions 32 of deck panel 20. Stiffening member 18's first end horizontal portion 101 is disposed on top of deck panel 20's left horizontal planar portion 50. Stiffening member 18's first end edge 77 does not project far enough horizontally to contact deck panel 20's vertical inverted U-shaped portion 52. Stiffening member 18's second end horizontal portion 103 is disposed on top of deck panel 20's right horizontal planar portion 58. Stiffening member 18's second end edge 79 does not project far enough horizontally to contact deck panel 20's vertical planar portion 60.

Figure 16:
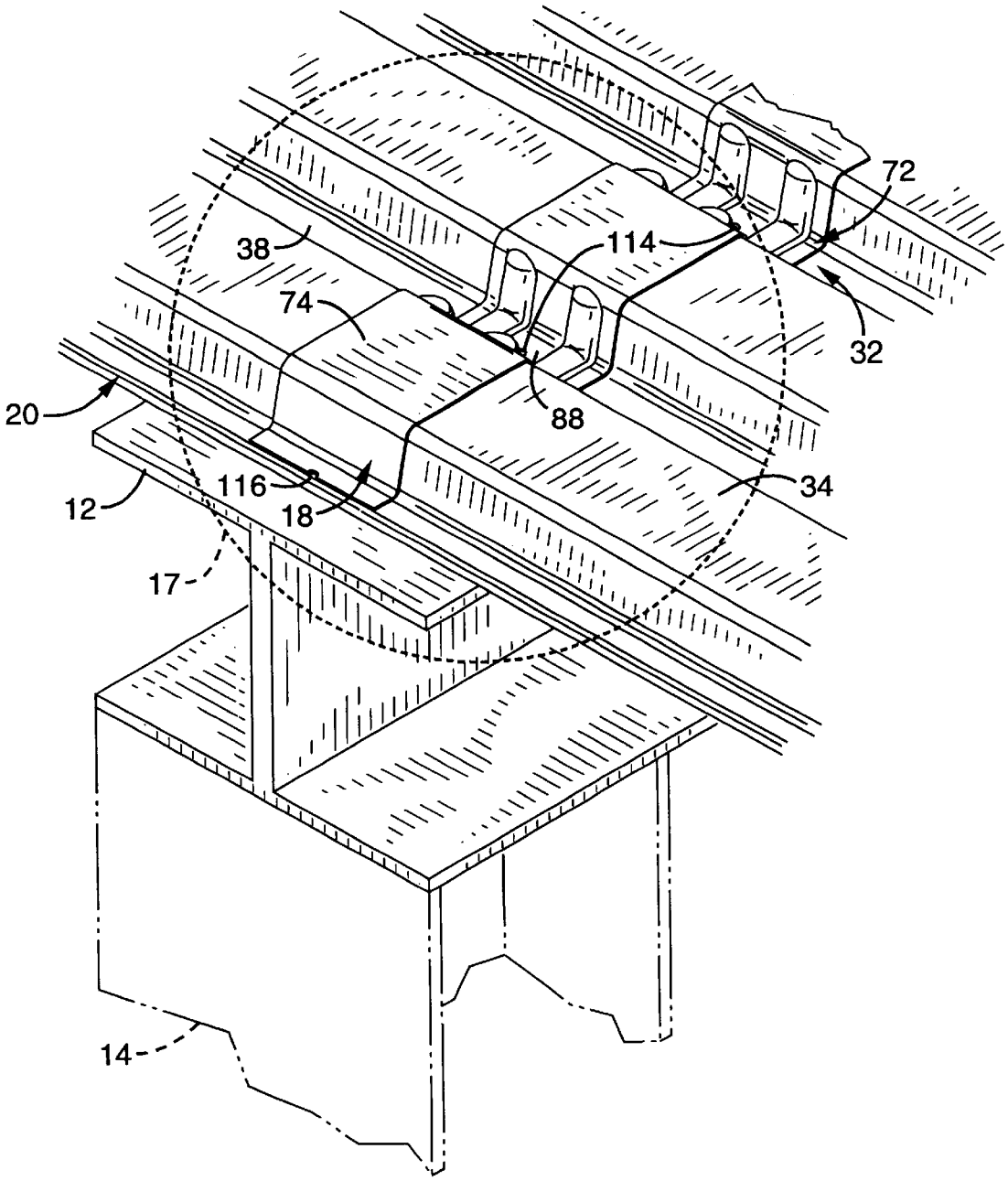
FIG. 16 is an enlarged fragmentary perspective view of the diaphragm, showing the attachment of the stiffening member to the deck panel and horizontal beam with welds.
Figure 17:
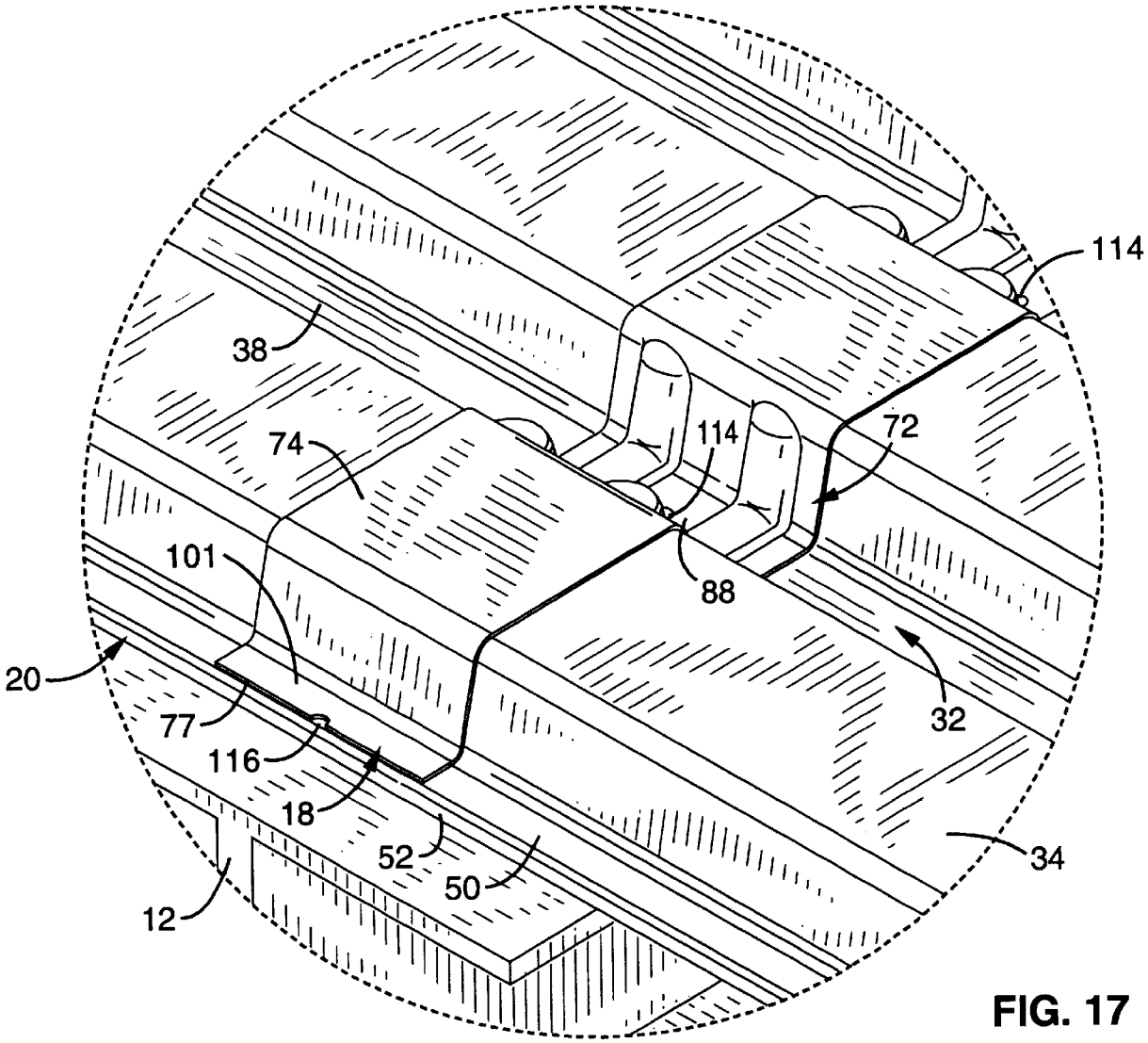
FIG. 17 is an enlarged fragmentary perspective view of the attachment of the stiffening member to the deck panel and horizontal beam with welds, of FIG. 16.

Stiffening member 18 may be attached to deck panel 20, and through it to horizontal support structure 12, by welds, pins, or other equivalent means known in the trade. As shown in FIG. 16, horizontal support structure 12 is supported by vertical support structure 14. Horizontal support structure 12 and vertical support structure 14 may be any of a wide variety of a building's structural components.

Figure 18:
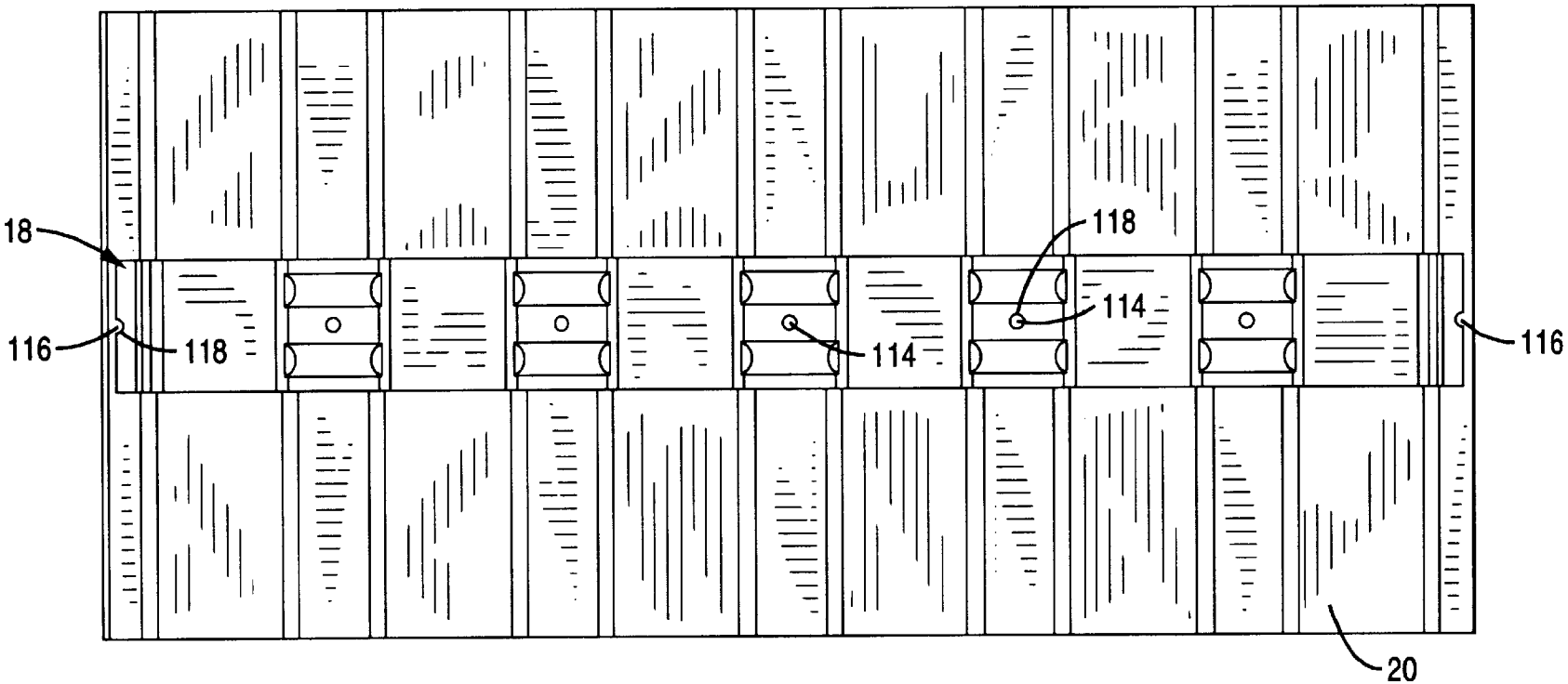
FIG. 18 is a plan view of the stiffening member and deck panel, showing the stiffening member welded to the deck panel through one of its holes and one notch, and showing the remainder of the stiffening member's holes and one notch before welding.

FIGS. 3, 16, and 18 show the attachment of stiffening member 18 to deck panel 20, and it to underlying horizontal support structure 12, using welds. This attachment is facilitated by the use of a stiffening member 18 having pre-punched holes 114 and pre-punched end notches 116. A single arc spot weld 118 is placed in each of stiffening member 18's pre-punched holes 114 and pre-punched end notches 116. Thus, in a stiffening member having five U-shaped portions 72 and six upper portions 74, a total of seven arc spot welds 118 are used.

Figure 19:
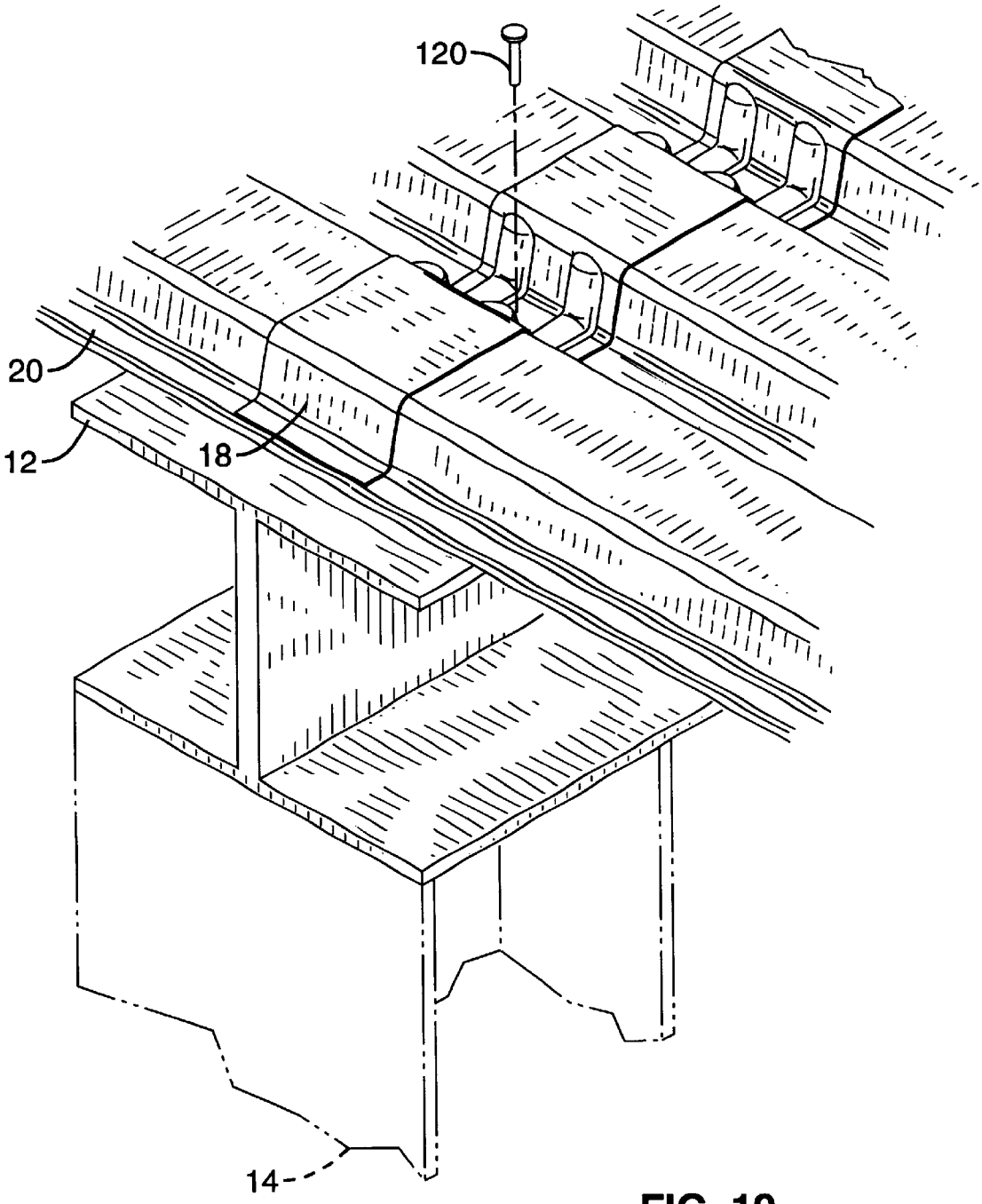
FIG. 19 is an enlarged partially exploded fragmentary perspective view of the diaphragm, showing the attachment of the stiffening member to the deck panel and horizontal beam with pins.

FIG. 19 shows the attachment of stiffening member 18 to deck panel 20, and to underlying horizontal support structure 12, using pins. For this attachment, a stiffening member 18 without holes 114 or notches 116 is used. A minimum of one pin 120 is placed in the center of each of stiffening member 18's floor portions 88 and in the center of each of first end edge 77 of first end horizontal portion 101 and second end edge 79 of second end horizontal portion 103, in the same locations as welds 118 used in a stiffening member that is welded to deck panel 20. Pins 120 are preferably type BX12 or BX14, manufactured by ITW Buildex. Thus, in a stiffening member having five U-shaped portions 72 and six upper portions 74, a minimum of seven pins 120 are used.

FIGS. 7, 8, and 9 show the arrangement of stiffening member 18 where two deck panels 20 are joined together in a sidelap joint. Two deck panels 20 are attached to each other utilizing a weld or pins. A stiffening member 18 is disposed on top of each deck panel 20 and is attached to each deck panel 20 by either welds or pins. As shown in FIGS. 8 and 9, the presence of the sidelap joint does not affect the position or attachment of each stiffening member 18 to each deck panel 20. Second end horizontal portion 103 of one stiffening member 18 and first end horizontal portion 101 of another stiffening member 18 fall short of, and do not contact, either vertical planar portion 60 of one deck panel 20 or vertical inverted U-shaped portion 52 of another deck panel 20. Thus, stiffening member 18 does not overlie the sidelap joint.

Figure 20:
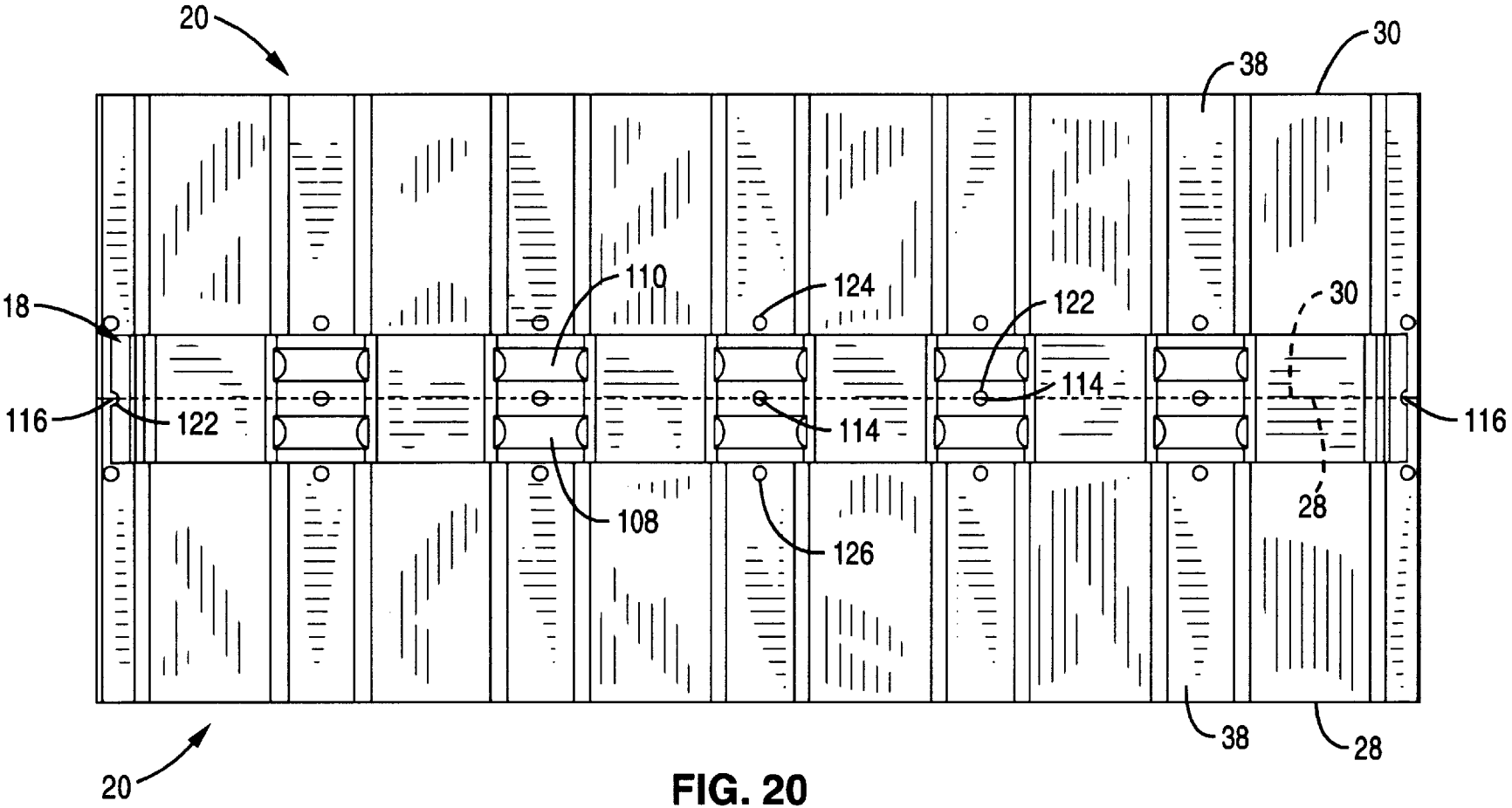
FIG. 20 is a plan view of the stiffening member and two deck panels, the deck panels joined in an interior butt joint, showing the stiffening member welded through the deck panels to the horizontal beam through one of its holes and one notch, and showing the remainder of the stiffening member's holes and one notch before welding, and further showing each of the two deck panels welded through to the horizontal beam at one point.

Stiffening member 18 may be used in attaching two deck panels 20 to each other at their ends in an interior butt joint, as shown in FIGS. 10 and 20. An interior butt joint is formed by abutting first end 28 of one deck panel 20 against second end 30 of another deck panel 20, such that the juncture of first end 28 and second end 30 resides on top of, and is centered on, horizontal support structure 12. Stiffening member 18 is disposed on top of, and is centered over, the juncture of the two deck panels 20, such that stiffening member 18 overlies both deck panels 20 of the interior butt joint. Stiffening member 18's raised rib 110 is disposed on top of one deck panel 20 and stiffening member 18's raised rib 108 is disposed on top of the other deck panel 20. Stiffening member 18 is attached to the abutting two deck panels 20, and through them to horizontal support structure 12, by a plurality of either welds or pins. If welds are used, and a stiffening member 18 with pre-punched holes 114 and pre-punched end notches 116 is used, holes 114 and notches 116 overlie the juncture of the two deck panels 20. As shown in FIG. 20, a single first arc spot weld 122 is placed in each of pre-punched holes 114 and pre-punched end notches 116. Each first arc spot weld 122 contacts first end 28 of one deck panel 20 and second end 30 of another deck panel 20. If pins are used, a stiffening member 18 without pre-punched holes 1 14 and without pre-punched end notches 116 is used. Pins are placed in the same locations in stiffening member 18 as first arc spot welds 122

An interior butt joint also requires a second and third series of welds or pins. If welds are used, as shown in FIGS. 10 and 20, a single second arc spot weld 124 is placed in the center of each floor portion 38 of one deck panel 20, approximately one inch from the juncture of proximal end 28 and distal end 30, and a single third arc spot weld 126 is placed in the center of each floor portion 38 of another deck panel 20, approximately one inch from the juncture of proximal end 28 and distal end 30. Unlike first arc spot weld 122, second arc spot weld 124 and third arc spot weld 126 do not contact stiffening member 18. Instead, second arc spot weld 124 and third arc spot weld 126 join deck panel 20 to horizontal support structure 12. If pins are used, a stiffening member 18 without pre-punched holes 1 14 and without pre-punched end notches 116 is used. Pins are placed in the same locations in deck panels 20 as second and third arc spot welds 124 and 126.

Stiffening members 18 and 111, when used with deck panel 20, provide a diaphragm with additional strength and resistance to horizontal shear forces. Without stiffening members 18 or 111, a corrugated deck will tend to buckle under significant horizontal load, such that the corrugations will fold over themselves or flatten out. With stiffening members 18 or 111, the corrugated deck will withstand greater horizontal shear forces before buckling occurs. For example, under test conditions, a deck without stiffening member 18 yielded under 6,160 pounds of load, but with stiffening member 18, withstood a load of 16,000 pounds without yielding.

Stiffening members 18 and 111 function to transfer the horizontal force from the deck to the underlying horizontal support structures. This function is enhanced by reinforcements of stiffening member 18's or 111's U-shaped portions 72, particularly at first corner 92 and second corner 94. Such reinforcements substantially reduce flexion between first side portion 86 and horizontal floor portion 88, and between second side portion 90 and horizontal floor portion 88. The reinforcements of U-shaped portion 72 may be constructed in different ways and may be shaped differently. It has been found that two raised ribs 108 and 110, or two tab portions 112, work well.

Stiffening members 18 and 111, when used in an interior butt joint of two deck panels 20, increase the horizontal shear resistance of the diaphragm compared to that of a diaphragm having an interior butt joint without stiffening members 18 or 111. The shear resistance is enhanced by the presence of a reinforcement (such as raised ribs 108 and 100 or tab portions 112) overlying each of the two deck panels 20 joined by the interior butt joint.

Stiffening members 18 and 111 are efficiently and cost-effectively installed in a corrugated deck diaphragm in that the welds used to attach stiffening members 18 and 111 to deck panels 20 are arc spot welds, the same type of welds as are used to attach deck panels 20 to underlying horizontal support structures 12. The same is true if pins are used to attach stiffening member 18 to deck panels 20; they are the same type of pins as are used to attach deck panels 20 to underlying horizontal support structures 12. Thus, the same tools are used to install stiffening members 18 or 111 as are used to construct a corrugated deck diaphragm. This results in a savings of time and in a savings of the costs for labor. In addition, stiffening members 18 and 111 can be installed with as few as seven welds or pins, resulting in a further savings of time and costs of materials and labor.

It will be understood by those skilled in the art that stiffening members having reinforcements other than two parallel raised ribs or side tab portions may be fashioned. Examples include a single raised rib, a plurality of raised ribs, raised ribs that are other than parallel to each other, partial raised ribs that are other than continuous, a rib that reinforces less than the entire U-shaped portion of the stiffening member, ribs that are constructed in a fashion other than being embossed, ribs that are other than hemicircular in cross-sectional shape, tabs that are other than continuous, tabs that are located other than on the edges of the stiffening member, other variations of both ribs and tabs, and other types of structures.

The foregoing disclosure of the corrugated stiffening member is illustrative of the preferred embodiment and is not a limitation upon the scope of the invention or the claims. There are other variations that fall within the scope of the claims. Accordingly, the scope of the invention should be determined with reference to the appended claims and not by the examples which have been given.

We claim:

1. A stiffening member, comprising:

a. a plurality of U-shaped portions, having an outer surface, wherein each said U-shaped portion comprises:

(i) a first substantially vertical, planar side portion;
(ii) a second substantially vertical, planar side portion;
(iii) a horizontal, planar floor portion;
(iv) a first corner integrally connecting said floor portion to said first substantially vertical, planar side portion;
(v) a second corner integrally connecting said floor portion to said second substantially vertical, planar side portion;
(vi) means for reinforcing one of said corners between one of said side portions and said floor portion, wherein said reinforcing means comprises a projecting portion projecting from said U-shaped portion's outer surface, and further, wherein said projecting portion comprises an elongate ribs generally hemicircular in transverse cross-section, projecting convexly from said U-shaped portion's outer surface;

b. a plurality of horizontal, planar upper portions residing in a plane parallel to and above the plane of said horizontal, planar floor portions;

c. an integral connection between each of said first substantially vertical, planar side portions and one of said horizontal, planar upper portions; and, d. an integral connection between each of said second substantially vertical, planar side portions and another of said horizontal, planar upper portions.

2. A stiffening member, comprising:

a. a plurality of U-shaped portions, having an outer surface, wherein each said U-shaped portion comprises:
(i) a first substantially vertical, planar side portion:
(ii) a second substantially vertical, planar side portion;
(iii) a horizontal, planar floor portion;
(iv) a first corner integrally connecting said floor portion to said first substantially vertical, planar side portion;
(v) a second corner integrally connecting said floor portion to said second substantially vertical, planar side portion;
(vi) means for reinforcing one of said corners between one of said side portions and said floor portion, wherein said reinforcing means comprises a projecting portion projecting from said U-shaped portion's outer surface;

b. a plurality of horizontal, planar upper portions residing in a plane parallel to and above the plane of said horizontal, planar floor portions;

c. an integral connection between each of said first substantially vertical, planar side portions and one of said horizontal, planar upper portions;

d. an integral connection between each of said second substantially vertical, planar side portions and another of said horizontal, planar upper portions; and e. means for attaching said stiffening member to a corrugated deck, wherein said attaching means comprises a weld.

3. The stiffening member of claim 2 wherein said weld comprises a weld in each said horizontal, planar floor portion of each said U-shaped portion.

4. A stiffening member, comprising:

a. a plurality of U-shaped portions, having an outer surface, wherein each said U-shaped portion comprises:
(i) a first substantially vertical, planar side portion;
(ii) a second substantially vertical, planar side portion;
(iii) a horizontal, planar floor portion;
(iv) a first corner integrally connecting said floor portion to said first substantially vertical, planar side portion)
(v) a second corner integrally connecting said floor portion to said second substantially vertical, planar side portion,
(vi) means for reinforcing one of said corners between one of said side portions and said floor portion, wherein said reinforcing means comprises a projecting portion projecting from said U-shaped portion's outer surface;

b. a plurality of horizontal, planar upper portions residing in a plane parallel to and above the plane of said horizontal, planar floor portions;

c. an integral connection between each of said first substantially vertical, planar side portions and one of said horizontal, planar upper portions;

d. an integral connection between each of said second substantially vertical, planar side portions and another of said horizontal, planar upper portions; and e. means for attaching said stiffening member to a corrugated deck, wherein said attaching means comprises a pin.

5. The stiffening member of claim 4, wherein said pin comprises a pin in each said horizontal, planar floor portion of each said U-shaped portion.

6. A diaphragm for a building, comprising:

a. a horizontal structural member having a longitudinal axis;

b. a deck, having parallel corrugations, wherein said deck resides on top of said horizontal structural member, such that said deck's corrugations are perpendicular to said horizontal structural member's longitudinal axis;

c. a stiffening member having a plurality of U-shaped portions, wherein each said U-shaped portion comprises:
(i) a first substantially vertical, planar side portion;
(ii) a second substantially vertical, planar side portion;
(iii) a horizontal, planar floor portion;
(iv) a first corner integrally connecting said floor portion to said first substantially vertical, planar side portion;
(v) a second corner integrally connecting said floor portion to said second substantially vertical, planar side portion; and
(vi) means for reinforcing one of said corners between one of said side portions and said floor portion, wherein said reinforcing means comprises a projecting portion projecting from said U-shaped portion's outer surface; and, d. means for attaching said stiffening member to said deck and to said horizontal structural member, such that said stiffening member's U-shaped portion s reside nestingly within said deck's corrugations.

7. The diaphragm of claim 6, wherein said stiffening member is elongate and has a longitudinal axis, and wherein said stiffening member's longitudinal axis is perpendicular to said deck's corrugations.

8. The diaphragm of claim 6, wherein said attaching means comprises a weld.

9. The diaphragm of claim 8, wherein said weld comprises a weld in each said horizontal, planar floor portion of said stiffening member.

10. The diaphragm of claim 6, wherein said attaching means comprises a pin.

11. The diaphragm of claim 10, wherein said pin comprises a pin in each said horizontal, planar floor portion of said stiffening member.

12. A deck joint, comprising:

a. a horizontal structural member;

b. a first deck panel having a first end and a second end;

c. a second deck panel having a first end and second end, wherein said first deck panel's second end abuts said second deck panel's first end, defining a juncture therebetween;

d. a stiffening member, having a plurality of U-shaped portions, wherein said stiffening member resides on top of said first and said second deck panels, overlying said juncture, and further, wherein each said U-shaped portion comprises.

(i) a first substantially vertical, planar side portion;

(ii) a second substantially vertical, planar side portion, (iii) a horizontal, planar floor portion;

(iv) a first corner integrally connecting said floor portion to said first substantially vertical, planar side portion;

(v) a second corner integrally connecting said floor portion to said second substantially vertical, planar side portion; and (vi) means for reinforcing one of said corners between one of said side portions and said floor portion, wherein said reinforcing means comprises a projecting portion projecting from said U-shaped portion's outer surface; and, e. means for attaching said stiffening member to said horizontal structural member.

13. The deck joint of claim 12, wherein said first and said second deck panels are corrugated.

14. The deck joint of claim 13, wherein said attachment means comprises a weld.

15. The deck joint of claim 13, wherein said attachment means comprises a pin.

* * * * *